US008458947B2

(12) United States Patent
Iosso et al.

(10) Patent No.: US 8,458,947 B2
(45) Date of Patent: Jun. 11, 2013

(54) CLEANING KIT FOR FIREARMS

(75) Inventors: Richard C. Iosso, Schaumburg, IL (US); Marianne Ortmann, Algonquin, IL (US)

(73) Assignee: International Processing Company of America, Elk Grove Village, IL (US)

( * ) Notice: Subject to any disclaimer, the term of this patent is extended or adjusted under 35 U.S.C. 154(b) by 0 days.

(21) Appl. No.: 12/930,732

(22) Filed: Jan. 14, 2011

(65) Prior Publication Data

US 2011/0209380 A1 Sep. 1, 2011

Related U.S. Application Data

(60) Provisional application No. 61/336,670, filed on Jan. 25, 2010.

(51) Int. Cl.
*F41A 29/02* (2006.01)

(52) U.S. Cl.
USPC ..... 42/95

(58) Field of Classification Search
USPC ..... 42/95
See application file for complete search history.

(56) References Cited

U.S. PATENT DOCUMENTS

| | | | | | |
|---|---|---|---|---|---|
| 41,481 | A | * | 2/1864 | Carr | 451/507 |
| 268,004 | A | * | 11/1882 | Davis | 401/9 |
| 933,285 | A | * | 9/1909 | Blair | 15/104.16 |
| 2,544,847 | A | * | 3/1951 | Malesky | 15/104.165 |
| 3,480,982 | A | * | 12/1969 | Saunders | 15/104.2 |

* cited by examiner

*Primary Examiner* — Michael Carone
*Assistant Examiner* — Reginald Tillman, Jr.
(74) *Attorney, Agent, or Firm* — Olson & Cepuritis, Ltd.

(57) ABSTRACT

A device for cleaning tubular passageways of a firearm that carries ignition products of a firearm propellant includes a relatively rigid hollow, tubular guide and a compliant cleaning rod within the bore of the hollow guide. The cleaning rod travels within the hollow guide before entering the tubular passageway to be cleaned. The cleaning rod is sufficiently flexible so as to be unable to support its own weight without substantial bending when supported at one end in a cantilever fashion. A cleaning kit is also provided including the cleaning device and a plurality of related cleaning items, such as brush-like cleaning elements.

13 Claims, 4 Drawing Sheets

CLEANING KIT FOR FIREARMS

CROSS-REFERENCE TO RELATED APPLICATIONS

This application claims the benefit of U.S. Provisional Application No. 61/336,670, filed Jan. 25, 2010, which is incorporated herein by reference.

TECHNICAL FIELD OF THE INVENTION

The invention relates to devices and kits for cleaning intricate passageways associated with firearm mechanisms.

BACKGROUND OF THE INVENTION

Firearms comprise a class of machines that have special requirements for their cleaning and maintenance. While firearms may be used in peaceful settings, for sporting events and the like, firearms are also relied upon to protect and defend the lives of military and law enforcement, as well as civilians placed in the protection of armed personnel. As such, reliable operation of the firearm is of ultimate importance. Regularly scheduled specialized cleaning and maintenance procedures are required to insure such performance.

Firearms typically employ a number of inter-fitting mechanisms and components that are machined with close tolerances. Firearms accordingly require cleaning for the same reasons associated with other types of precision machines. As a mechanism is operated, certain parts may tend to wear, and thereby create material which would foul or otherwise hinder smooth operation of the various moving parts. In addition, firearms rely on the ignition or combustion of propellants broadly referred to as "gunpowder." In times past, this material was made in the form of a powder, with individual particles assuming a ball shape. More recently, so-called "stick" and flake powders have been developed. In stick powders, for example, particles of the combustible propellants are extruded in the form of short, small-sized cylinders or "sticks." Each type of propellant burns differently and has its own types of combustion products.

In modern usage, propellants are contained within a brass or nickel case to which is fitted a primer to initiate ignition of the propellant, and a bullet or other projectile to be launched from the firearm. Ignition typically occurs with the propellant located within a closed firing chamber where substantial pressure levels are developed by rapid gas expansion of the propellant. Once developed, pressure from the propellant gases is applied against the projectile, forcing the projectile to travel along the barrel until the projectile exits at the muzzle of the barrel.

A number of firearms in popular use today are based on a design originally adopted by the U.S. Military under the "M16" designation. Today, several variants of this design are in production and use. In broad terms, this type of firearm includes a gas operated automatic loading feature, powered by diverting a portion of the energy developed from ignition of the propellant, back to the operating mechanism. This provides power for a number of functions that are automatically performed from the firing of one round to the next.

In the automatic, gas powered firearm operation considered here, ignition or oxidation of the propellant causes a rapid expansion of gases resulting from its ignition. Unfortunately, such ignition is typically incomplete, and takes place over a finite period of time during which a portion of the propellant is consumed. As mentioned, the gases produced by ignition propel the projectile down the barrel of the firearm.

Unburnt propellant and combustion products are also carried by the gas stream, and follow the projectile during its trip down the firearm barrel. During this time, additional quantities of propellant are ignited in the barrel, further adding to the propulsion forces pushing the projectile toward the barrel muzzle. In the M16 family of firearms, for example, a port located in the firearm barrel, adjacent the muzzle, diverts a portion of the exiting gas (and particles contained therein) to perform automatic cycling action of various mechanisms associated with the firearm. For example, the diverted gas pressure is used to eject a casing from the firing chamber while loading a fresh cartridge into the firing chamber. Gas pressure is also used to force a movable bolt into position to enclose the firing chamber, providing a pressure-tight seal that resists the violent pressure rise of the propellant within the firing chamber.

Unfortunately, while pressure operated cycling has proven successful for its intended purpose, combustion products, including unburnt propellant and other undesirable contaminants, are carried within the gas stream, being brought into contact with close tolerance movable mechanisms for which automatic operation is desired. This contamination, sometimes referred to as "fouling," necessitates regular cleaning as part of a routine maintenance procedure that insures reliable operation of the firearm. A problem arises however, since gas pressures and contaminants carried by those pressures are made to travel increasingly miniaturized tubular passageways.

SUMMARY OF THE INVENTION

A device for cleaning tubular passageways of firearms is provided. The device provides cleaning of tubular passageways that carry ignition products of a firearm propellant. A hollow guide is provided with a relatively rigid construction that may be defined as the ability to support its own weight without substantial bending when supported at one end. The hollow guide defines a substantially uniform continuous and uninterrupted bore with an enlarged end for receiving a free end of the tubular passageway to be cleaned. Preferably, the enlarged end of the bore is provided with an internal chamfer or substantially concave recess at one end of the hollow guide, for receiving one end of the tubular passageway. In a preferred embodiment, the concave recess of the guide end is provided with a generally conical shape.

The device also includes a cleaning rod dimensioned to fit within the bore of the hollow guide and the tube passageway. The cleaning rod is compliant so as to be flexible while still being able to be pushed along the internal bore of the guide and the tubular passageway. With the compliant cleaning rod of the invention, very long and very small diameter tubular passageways, even those passageways having a kink or offset can be readily accommodated without concern for jamming or otherwise obstructing the tubular passageway.

Preferably, the cleaning rod has an outer surface which is substantially uniform, continuous and uninterrupted. In one embodiment, a removable connection is provided at a distal end of the cleaning rod for removably attaching a cleaning element such as a brush, having an enlarged size relative to the cleaning rod cross section. The cleaning element could have a variety of shapes such as a cylindrical and/or conical shape, for example.

A cleaning kit for cleaning a tubular passageway of a firearm that carries ignition products is also provided. The hollow, rigid guide defines a substantially uniform, continuous and uninterrupted bore with an enlarged end portion for receiving a free end of the tubular passageway to be cleaned.

The flexible, or compliant cleaning rod is provided within the bore of the hollow guide for travel therealong so as to enter the tubular passageway.

In either embodiment, the hollow guide may be made of virtually any material as may be desired. Preferably, the hollow guide is translucent and most preferably the guide is substantially transparent so as to observe the present location of the cleaning element as the element is applied in a cleaning operation.

DESCRIPTION OF THE PREFERRED EMBODIMENTS OF THE INVENTION

Figure 1:
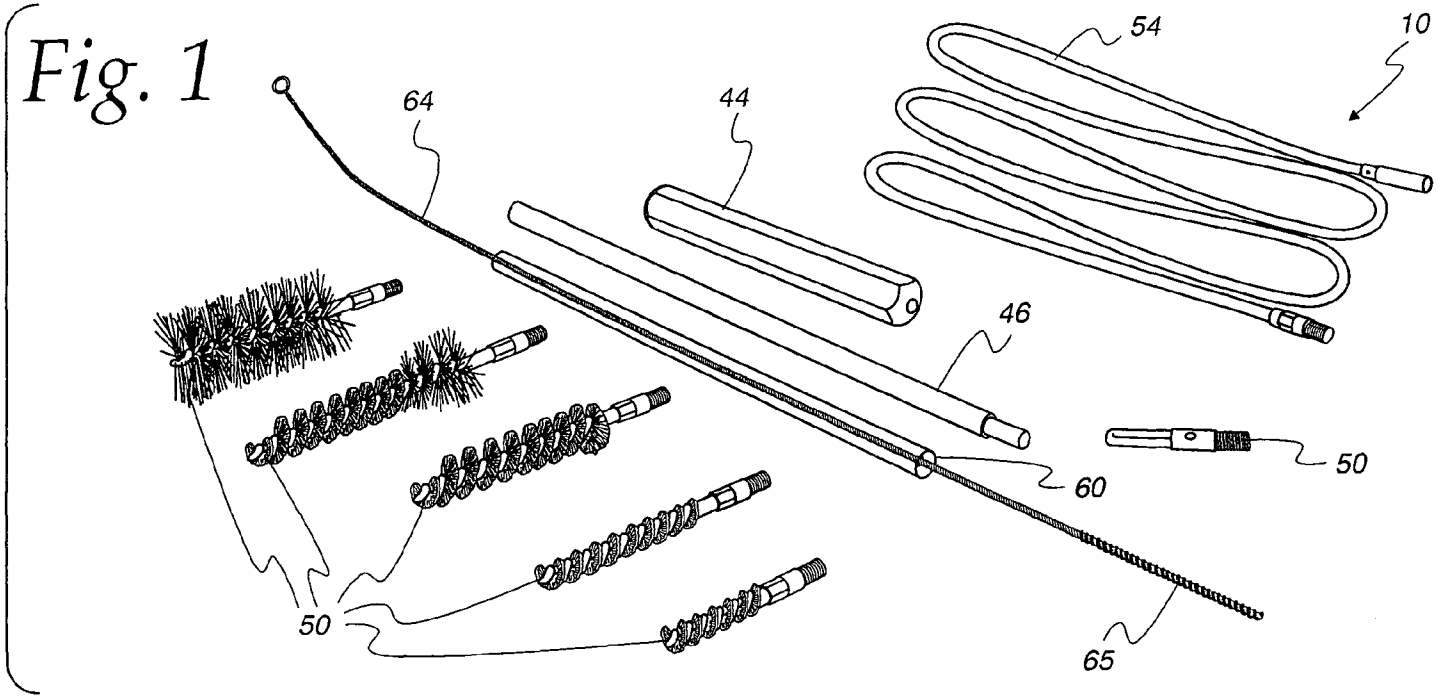
FIG. 1 is a perspective view of a cleaning kit for cleaning one or more tubular passageways of a firearm.

The invention disclosed herein is, of course, susceptible of being embodied in many different devices. Shown in the drawings and described herein below in detail are preferred embodiments of the invention. It is to be understood, however, that the present disclosure is an exemplification of the principles of the invention and does not limit the invention to the illustrated embodiments.

Figure 2:
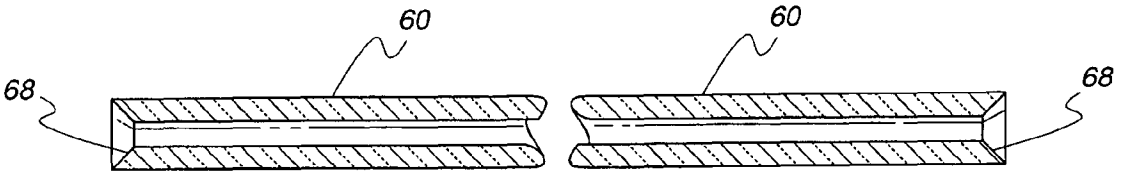
FIG. 2 is a cross-sectional view of a hollow guide component thereof.

Referring now to the drawings, a preferred embodiment of a cleaning kit 10 is shown in FIGS. 1 and 2, and includes a hollow, tubular guide 60 with a cleaning rod 64 therewithin, as well as cleaning elements 50. Cleaning kit 10 is employed to clean various tubular passageways of a firearm that carry ignition products of a firearm propellant. An example of one such firearm is shown in FIGS. 3-6. As is known, contamination by ignition products, formed at high temperatures and pressures, present a unique set of challenges to maintaining the tubular passageway clean and free of contamination. A variety of specialized cleaning equipment and solutions is typically employed to dissolve and loosen contamination that is typically formed on the inner surface of a tubular passageway. The chemical reactions associated with ignition of a firearm propellant are relatively energetic, being sufficient to cause decomposition products not usually encountered in other types of equipment and machinery.

Figure 3:
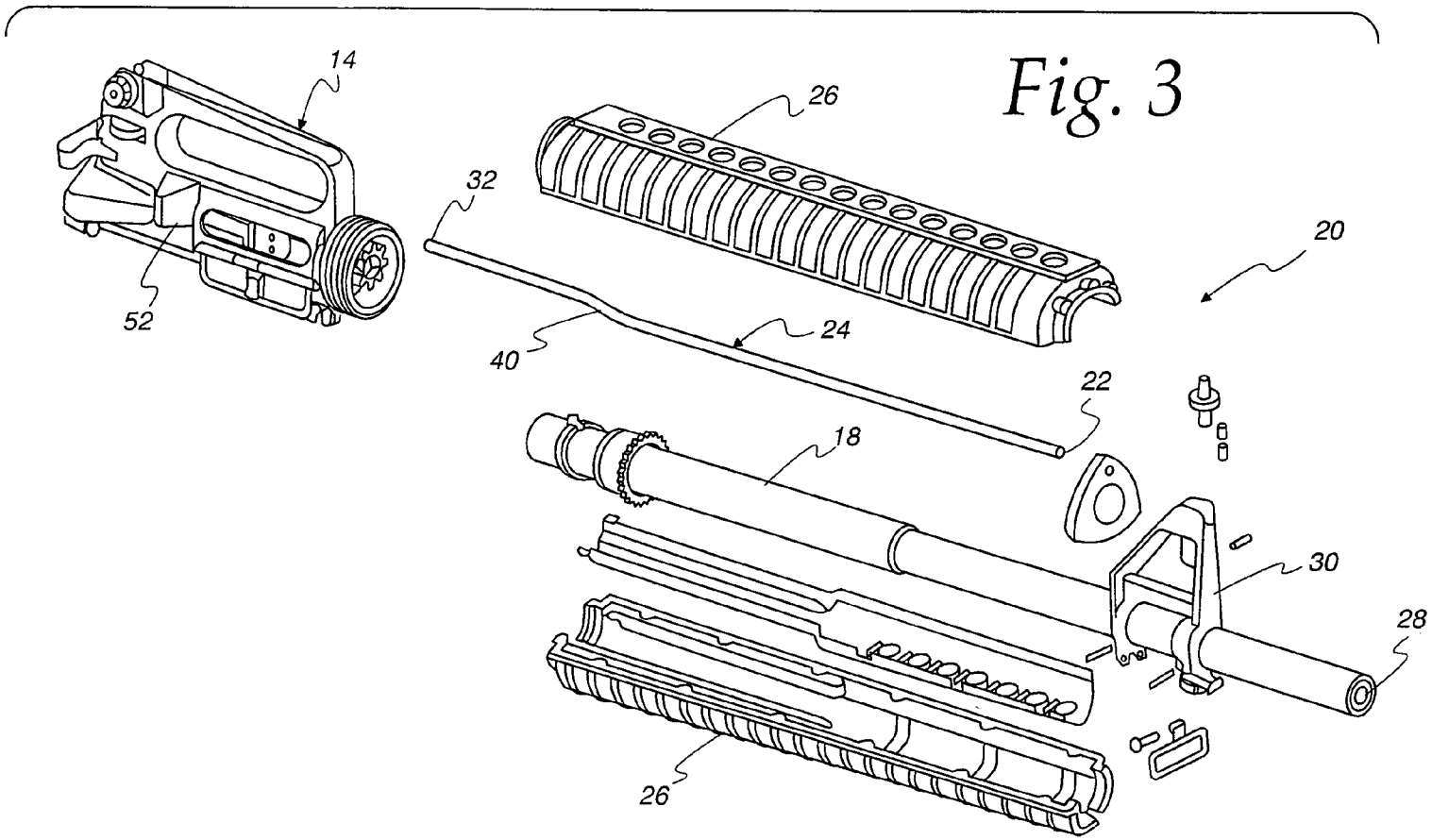
FIG. 3 is a fragmentary perspective view of a firearm receiver and forearm assembly.
Figure 4:
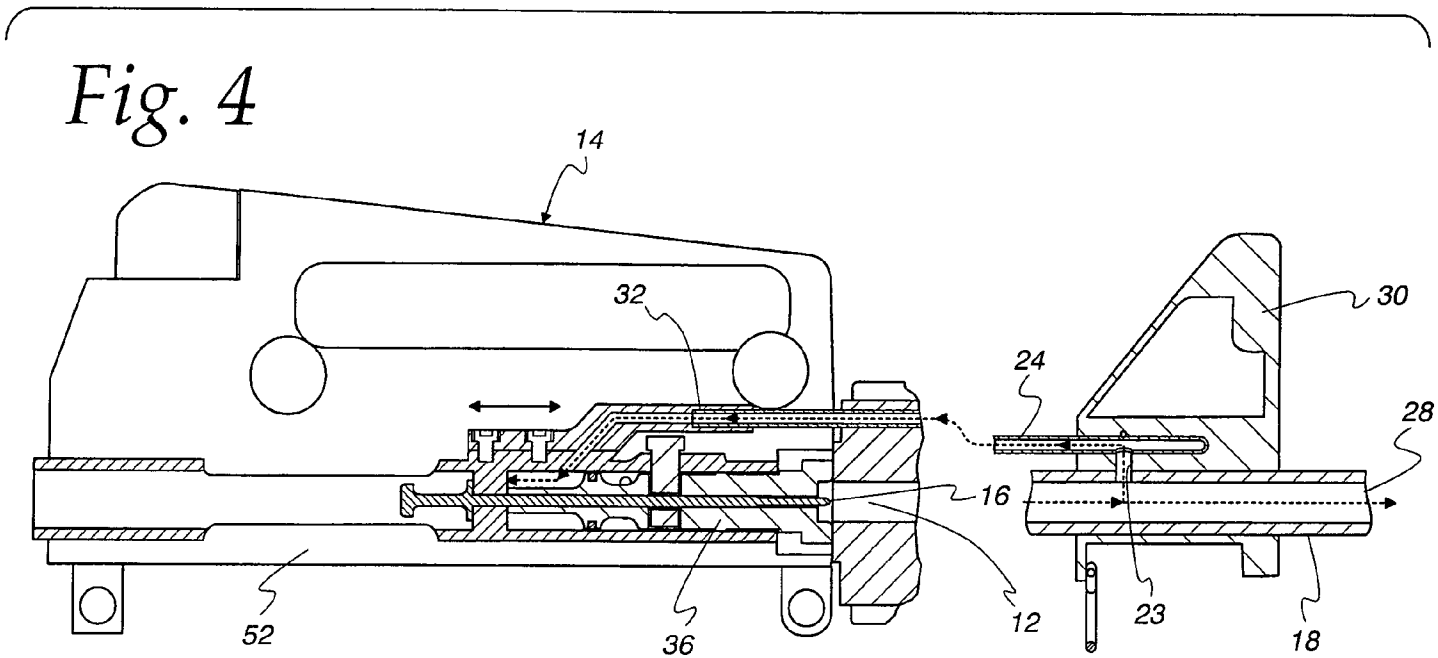
FIG. 4 is a fragmentary cross-sectional view of the firearm receiver.

Referring to FIGS. 3 and 4, a barrel assembly or forearm assembly 20 is joined to receiver 14 of a rifle. Forearm assembly 20 includes a barrel 18, a gas tube 24 and mating forearm grips 26. Gas tube 24 extends between receiver 14 and a distal end of barrel 18, adjacent the barrel muzzle 28. Also located adjacent muzzle 28 is a front sight 30 secured to barrel 18. As schematically indicated in FIG. 4, a bore or passageway extends from barrel 18 through front sight 30 so as to communicate with a distal end 22 of gas tube 24 (see FIG. 3). An opposed proximal end 32 of gas tube 24 extends into receiver 14. Thus, ignition products, notably gas pressures traveling along gas tube 24, enter mechanism located within housing 52 of receiver 14. This mechanism provides an automatic cycle of operation of the firearm. Included in the cycle of operation, for example, is ejection of the spent ammunition casing, feeding of a fresh round of ammunition into chamber 12 and closing a bolt 36 (see FIG. 4) to render chamber 12 pressure-tight so as to withstand energetic ignition of the firearm propellant.

When the firearm is discharged, the propellant is ignited causing ignition products, notably gas pressure loaded with contaminants, to be released for travel toward the distal end of barrel 18, so as to exit muzzle 28. A bullet or other projectile is seated in barrel 18 immediately ahead of the gas pressure and is expelled from barrel 18 under force of the gas pressure. The schematic illustration of FIG. 4 shows a passageway in barrel 18 located adjacent muzzle 28 that extends into front sight 30. This passageway 23 carries a portion of the gas pressure toward gas tube 24, for eventual delivery to the mechanism located in receiver 14, thus completing a successive cycle of operation.

Referring to FIG. 4, ignition of the firearm propellant typically occurs in a firearm chamber indicated at 12 in FIG. 4. Chamber 12 is located within a receiver 14 so as to communicate with the internal bore of barrel 18. Receiver 14 belongs to a family of firearms in popular use today, that is based upon a design adopted by the U.S. Military under the "M16" designation. As mentioned, this type of firearm employs automatic gas operation of various mechanisms located within the receiver. Power for this operation is obtained from the ignition of firearm propellant carried in ammunition (not shown) disposed in chamber 12. Ignition occurs when a firing pin 16 shown in FIG. 4 contacts a primer component of ammunition loaded within chamber 12. Ignition products propel a bullet or other projectile (not shown) along barrel 18.

Unfortunately, ignition of the propellant is not complete nor does it occur instantly. As the bullet and gas pressure travels down barrel 18, ignition products resulting from the chemical oxidation of the propellant travel down the barrel at high temperatures and pressures. A certain amount of unburnt propellant also travels down the barrel and ignition of the traveling propellant occurs along barrel 18 and sometimes appears a visible flash as the ignition products exit muzzle 28. Of course, these ignition products also travel within gas tube 24 and lead to contamination of the gas tube and mechanism within receiver 14. Thus, in the example herein, two tubular passageways, the inner bore of barrel 18 and the inner bore of gas tube 24 must be periodically serviced to remove contamination so as to prevent malfunction or deteriorated operation of the firearm. For example, substantial impaction of gas tube 24 will cause insufficient energy to be applied to the mechanism within receiver 14, with the firearm either being unable to cycle altogether, or to cycle in an unintended manner. Accordingly, it is important that the barrel and the gas tube be maintained so as to prevent such malfunction.

The M16 family of weapons introduced new materials and methods of fabrication and assembly that were developed in the aerospace industry. Gas pressures and contaminants carried by those pressures were made to travel increasingly miniaturized passageways. Miniaturization is possible since relatively high pressure levels (e.g. 16,000 psi) could be relied upon to drive sufficient volumes of flow through the long, relatively small bore passageways of the firearm. One example of a small passageway is the relatively small diameter gas tube of the M16 family of firearms. This gas tube extends from the front sight, adjacent the muzzle, to the receiver mechanism, and communicates with a port in the barrel to divert a portion of the ignition products back to the receiver to operate a variety of mechanisms that cycle the firearm. The diameter of the gas tube is considerably smaller than the 0.223 inch barrel bore, and as mentioned, extends approximately the full length of the barrel. In addition, the gas tube has an offset or kink in its midportion. The gas tube of course, contains contamination carried in the gas flow created by the ignition products.

Today, gas tubes commonly employed throughout the M16 family of firearms (e.g. M16, M4 and AR15 rifles) range in length from approximately 9.75 inches to over 13 inches. These gas tubes have an internal diameter of approximately 0.094 inches, and the medially located lateral offset measures approximately 0.25 inches. Due to its recess from the muzzle end, the gas tube port is virtually inaccessible from the muzzle. Access to the barrel and gas tube from the receiver end requires partial disassembly of the firearm, to expose the internal mechanism of the barrel assembly, with the discharge end of the gas tube recessed approximately 5.75 inches from the receiver end of the barrel assembly. Even with disassembly of the firearm, cleaning of the gas tube is difficult. Unfortunately, there are field reports of cleaning objects being inextricably lodged in gas tubes, often requiring the firearm to be taken out of service for repairs by a trained armorer. Due to the difficulty and risk of injury to the firearm, cleaning of the gas tube is oftentimes ignored altogether, even though stoppage of the firearm would very likely result if the gas tube malfunctioned.

As schematically indicated in FIG. 4, the inner bore of barrel 18 (e.g. 0.223 inches) is substantially larger than the inner bore of gas tube 24 (e.g. 0.094 inches). As can be seen with reference to FIG. 3, the lengths of gas tube 24 and barrel 18 are approximately equal. As a result, cleaning the internal bore of gas tube 24 presents an unusually rigorous challenge due to the frictional forces involved. Difficulty is further increased by a kink or offset 40 in the medial portion of gas tube 24, (see FIG. 3).

Figure 5:
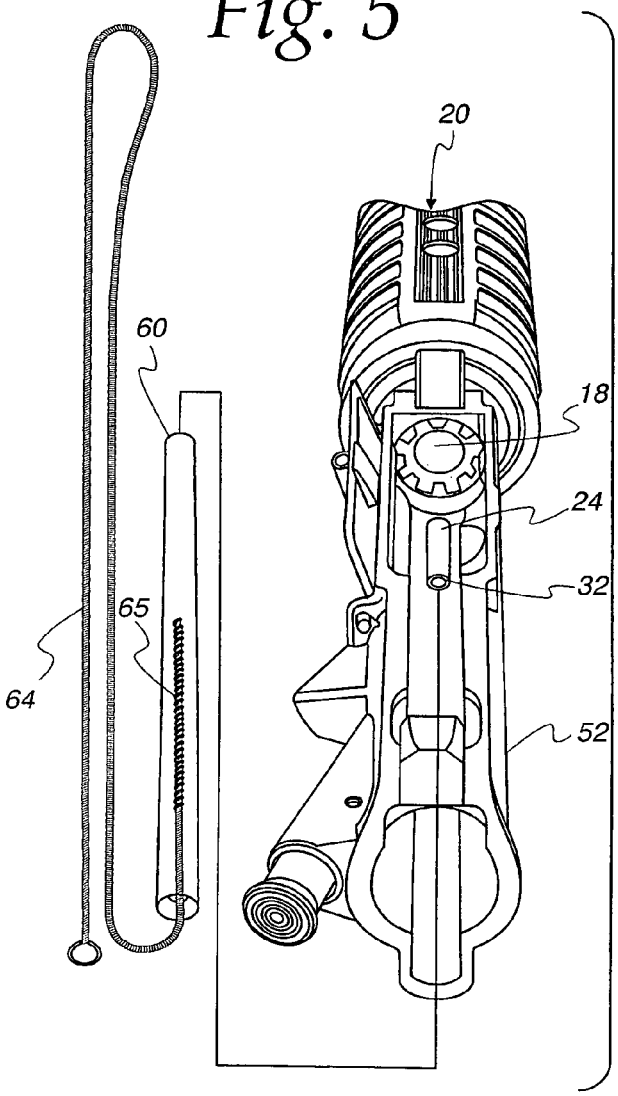
FIG. 5 is a fragmentary perspective view of the forearm assembly of FIG. 3 shown prior to a cleaning operation.
Figure 6:
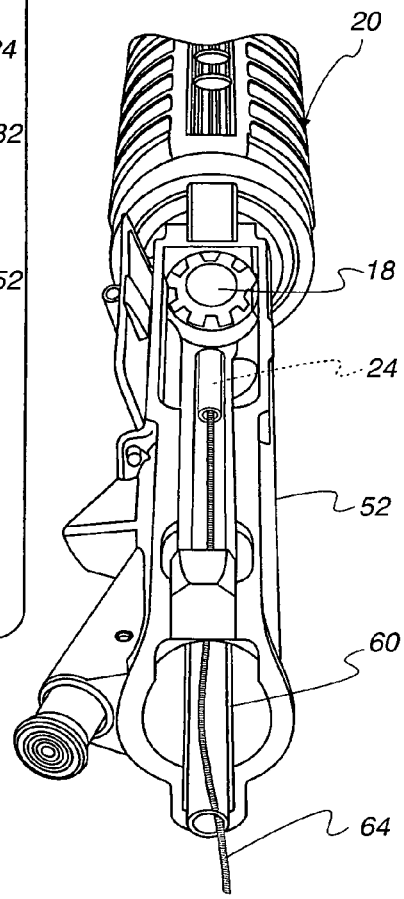
FIG. 6 is a fragmentary perspective view of the forearm assembly of FIG. 3 during a cleaning operation.

Referring to FIGS. 5 and 6, field-expedient cleaning practices dictate that complete disassembly of the firearm can be avoided when this is impractical. FIGS. 5 and 6 show forearm assembly 20 of a partially disassembled firearm with the proximal end of barrel 18 exposed for cleaning. Various components of cleaning kit 10 of FIG. 1 may be readily assembled for the purpose of cleaning barrel 18. For example, a handle 44 may be attached to a rigid shaft 46. A variety of cleaning elements 50 are attached to the distal end of shaft 46 to form a cleaning rod for advancing the cleaning elements 50 along barrel 18. As can be seen, for example in FIG. 5 the relatively large bore and straight line shape of barrel 18 and the relatively large opening of receiver housing 52 permits ready cleaning of barrel 18 using a cleaning rod assembly, as described. As an alternative, a flexible cleaning element 54 in the form of a flexible rope, tether or the like may be employed. Tether 54 is dropped into barrel 18 from its muzzle end and is fished through receiver housing 52. A cleaning element 50 is then attached to one end of tether 54 and is dragged through barrel 18 by applying tension to the tether adjacent the muzzle of the barrel.

Cleaning of gas tube 24, however, presents a more rigorous challenge because of the relatively small size and long length of the gas tube and its recessed location within the receiver end of the barrel assembly. Because of the long length of the gas tube and its intermediate offset, cleaning devices to be inserted within the gas tube must be compliant so as to be flexible while still being able to be pushed along the internal bore of the tubular passageway so as to apply a cleaning action to the internal barrel surface.

In one embodiment, a compliant cleaning rod 64 is provided for cleaning the interior or tubular passageway of gas tube 24. Cleaning rod 64, unlike guide 60, is substantially compliant, flexible or conformable to offsets, twists and turns of the tubular passageway to which it is applied. In one example, cleaning rod 64 may be described as being sufficiently flexible so as to be unable to support its own weight without substantial bending when supported at one end in a cantilever fashion. With the compliant cleaning rod of the invention, very long and very small diameter tubular passageways, even those passageways having a kink or offset can be readily accommodated without concern for jamming or otherwise obstructing the tubular passageway.

Preferably, cleaning rod 64 has an outer surface which is substantially uniform, continuous and uninterrupted. In one embodiment, a removable connection is provided at a distal end of the cleaning rod for removably attaching cleaning element such as a brush having a variety of shapes such as cylindrical and/or conical shapes, for example. Alternatively, cleaning rod 64 can be provided with a fixed brush at the distal end thereof.

In the illustrated embodiment, cleaning rod 64 is made of a twisted wire construction that provides substantial translational compressive strength with a minimal cross-sectional area and terminates in an elongated brush 65. Cleaning rod 64 can be made of relatively inexpensive commercially practical materials. Because of its flexibility, it is difficult to introduce the distal end of cleaning rod 64 into the proximal end 22 of gas tube 24 associated with the rifle forearm assembly and receiver housing shown, for example, in FIGS. 5 and 6. One or more cleaning elements 50 also can be attached to the distal end of cleaning rod 64 if desired, to provide the desired intimate contact and scrubbing action with respect to the inner surface of the gas tube. Usually hollow guide 60 is first fitted to the proximal end 22 of gas tube 24 of the rifle, before cleaning rod 64, guided by hollow guide 60, is introduced into the tubular passageway to be cleaned.

The hollow guide 60 is preferably made to have a relatively rigid construction that may be defined as the ability to support its own weight without substantial bending when supported at one end. The hollow guide preferably defines a substantially uniform continuous and uninterrupted bore with an enlarged bore end portion 68 for receiving a free end of the tube to be cleaned or chamfered to mate with the free end of the tube to be cleaned. With the hollow guide, cleaning operations can be readily completed owing to its rigidity and substantial length to bring its entry end into a position of prominence, rather than being recessed within the equipment to be cleaned. Preferably, guide 60 is provided with a chamfer or an enlarged bore end portion sized to receive the free end of the tube to be cleaned at both ends of the guide 60.

To aid in joining rod 60 to gas tube 24, the distal end of guide 60 is provided with a concave recess to provide ready insertion of the guide end on the proximal end 22 of gas tube 24. Preferably, the recessed end that receives the gas tube 24 is formed with an internal chamfer of generally conical contour. The bore of the hollow guide is dimensioned to receive the cleaning rod and any cleaning elements attached thereto or associated therewith. Most preferably, the bore of the hollow guide is dimensioned approximately the same as the bore of the gas tube passageway to which it is fitted. This relative dimensioning is simply accomplished when the gas tube has a relatively thin wall. If the wall of the tube to be cleaned is substantially thicker, the guide may be fitted with an enlarged or "bell" end, or the simple expedient of a splice tube may be employed when the guide bore and wall thickness are substantially the same as the tube to be cleaned.

The hollow guide 60 may be made of virtually any material as may be desired, such as a plastic composition. Preferably, the hollow guide is translucent and most preferably the guide is substantially transparent so as to observe the present location of the cleaning element as the element is applied in a cleaning operation.

As indicated in FIG. 2 preferably, both ends of guide 60 may be provided with a concave recess at the respective end portions 68 to further simplify the cleaning procedure. If desired, cleaning rod 64 may be partially inserted in guide 60, as illustrated, prior to fitting the guide to the gas tube. Alternatively, the gas tube may be first joined to guide 60 and cleaning rod 64 thereafter inserted through the guide so as to enter gas tube 24 at its proximal end 22. Thereafter, the cleaning rod 64 is pushed to apply translational compressive force to its distal end. As mentioned, it is generally preferred that the distal end of cleaning rod 64 carry a cleaning element 50 although such can be omitted and the cleaning rod 64 can itself provide the desired cleaning action to the tubular passageway of gas tube 24.

Guide 60 may be made of virtually any material as may be desired. It is, however, preferred that guide 60 be made translucent and preferably transparent through a choice of materials involved. For example, a clear plastic composition may be used for guide 60. This allows an operator a visual confirmation of the current position of the distal end of cleaning rod 64 at any point in time. Guide 60 can be made substantially rigid either at its time of manufacture or later during a strain hardening or the like operation. Guide rod 64, as shown, has a twisted wire configuration, although other configurations may be employed as well. For example, the guide rod could resemble a well known beaded key chain construction that is highly flexible in lateral directions but which may, when guided within the internal bore of guide 60, apply translational compressive force as the bead chain is advanced along the tubular passageway being cleaned.

As a further alternative, guide 60 may be adapted for insertion within the proximal end of barrel 18. For example, it may be possible to construct guide 60 of sufficient wall thickness such that its outer diameter approximates the internal bore of barrel 18. If a cleaning element 50 having an outer size too large for insertion in guide 60 is employed, the cleaning rod may first be inserted completely through guide 60 with the cleaning element thereafter attached to a protruding, distal end of the guide rod. The resulting assembly may then be quickly and easily guided to the proximal end of barrel 18 with the cleaning element guide inserted in the tubular passageway of barrel 18. The guide 60 can be used to apply translational compressive force to the cleaning element during initial entry into barrel 18, if desired.

The foregoing is to be taken as illustrative, but not limiting. Still other variants within the spirit and scope of the present invention will readily present themselves to those skilled in the art.

What is claimed is:

1. A device for cleaning a rifle gas tube of a firearm that carries ignition products of a firearm propellant, the rifle gas tube having a free end with an outer diameter, the device comprising:

a hollow translucent, tubular guide of rigid construction sufficient to support its own weight without substantial bending when supported at one end, the hollow translucent tubular guide defining a substantially uniform, continuous and uninterrupted bore with chamfered end portions sized for receiving therewithin the free end of the rifle gas tube; and a cleaning rod within the bore of the hollow guide for travel therealong so as to enter the rifle gas tube;

the bore of the tubular guide having substantially the same dimension as the bore of the rifle gas tube.

2. The device according to claim 1 wherein the cleaning rod includes a distal end with brush bristles for contacting the rifle gas tube.

3. The device according to claim 1 wherein the cleaning rod includes a distal end with fibers for contacting the rifle gas tube.

4. The device according to claim 1 wherein the cleaning rod is of flexible, compliant construction, being insufficient to support its own weight without substantial bending when supported at one end.

5. The device according to claim 1 wherein the hollow guide is generally cylindrical.

6. The device according to claim 1 wherein the hollow guide is generally transparent.

7. The device according to claim 1 wherein the cleaning rod has a distal end with a removable connection for removably attaching a cleaning element.

8. The device according to claim 7 wherein the removable connection comprises a threaded end portion of the cleaning rod.

9. The device according to claim 1 wherein the cleaning rod has a substantially uniform, continuous and uninterrupted outer surface.

10. A cleaning kit for cleaning a rifle gas tube of a firearm that carries ignition products of a firearm propellant, the rifle gas tube having a free end with an outer diameter, the device comprising:

a hollow translucent, tubular guide of rigid construction sufficient to support its own weight without substantial bending when supported at one end, the hollow translucent, tubular guide defining a substantially uniform, continuous and uninterrupted bore with chamfered end portions sized for receiving therewithin the free end of the rifle gas tube;

a cleaning rod within the bore of the hollow guide for travel therealong so as to enter the rifle gas tube, the cleaning rod having a distal end with a removable connection for removably attaching a cleaning element; and at least one cleaning element removably attachable to the distal end of the cleaning rod;

the bore of the tubular guide having substantially the same dimension as the bore of the rifle gas tube.

11. The cleaning kit according to claim 10 wherein the cleaning rod is of compliant, flexible construction, being insufficient to support its own weight without substantial bending when supported at one end.

12. The cleaning kit according to claim 10 wherein the cleaning rod has a substantially uniform, continuous and uninterrupted outer surface.

13. The cleaning kit according to claim 10 wherein the cleaning rod has a distal end with a removable connection for removably attaching a cleaning element.

* * * * *